US006948193B2

(12) United States Patent
Hsu

(10) Patent No.: US 6,948,193 B2
(45) Date of Patent: Sep. 27, 2005

(54) LAVATORY CLEANSER DISPENSING DEVICE

(76) Inventor: Johnson J. Y. Hsu, 3F, No. 14, Ta-En Street, Hsi Tun Area, Taichung (TW)

( * ) Notice: Subject to any disclaimer, the term of this patent is extended or adjusted under 35 U.S.C. 154(b) by 0 days.

(21) Appl. No.: 10/749,567

(22) Filed: Jan. 2, 2004

(65) Prior Publication Data

US 2005/0144709 A1 Jul. 7, 2005

(51) Int. Cl.[7] ..... E03D 9/02; E03D 9/03

(52) U.S. Cl. ..... 4/227.1; 4/227.4; 4/227.6; 4/227.7; D23/208

(58) Field of Search ..... 4/222, 227.1, 227.4, 4/227.5–227.7; D23/208

(56) References Cited

U.S. PATENT DOCUMENTS 4,247,070 A * 1/1981 Dirksing ..... 4/227.7
4,436,269 A * 3/1984 Dirksing et al. ..... 4/227.1
4,455,692 A * 6/1984 Hegge et al. ..... 4/227.1
D280,387 S * 9/1985 Morgan ..... D23/208
4,558,471 A * 12/1985 Brown et al. ..... 4/227.1
4,632,350 A * 12/1986 Brown ..... 4/227.7
4,745,638 A * 5/1988 Richards ..... 4/227.1
6,101,639 A * 8/2000 Hsu ..... 4/227.7

* cited by examiner

*Primary Examiner*—Tuan Nguyen
(74) *Attorney, Agent, or Firm*—Bacon & Thomas, PLLC

(57) ABSTRACT

An improved lavatory cleanser dispensing device that is height-adjustable and capable of quantitatively dispensing cleanser is composed of a fixing member and a shell. The fixing member includes a hanging portion at a top side thereof to be hung on a toilet water tank and a plurality of locating portions formed at a bottom section thereof and in top-down arrangement. The shell includes at least one chamber inside, a plurality of inlets and outlets running therethrough to enable the chamber to communicate with outside, and at lease one positioning portion detachably mounted on the locating portions of the fixing members.

4 Claims, 7 Drawing Sheets

LAVATORY CLEANSER DISPENSING DEVICE

BACKGROUND OF THE INVENTION

1. Field of the Invention

The present invention relates generally to lavatory cleanser dispensing devices, and more particularly to a lavatory cleanser dispensing device that is height-adjustable and capable of quantitatively dispensing cleanser.

2. Description of the Related Art

As shown in FIG. 7, a conventional lavatory cleanser dispensing device 90 that the lavatory cleanser and aromatic agent can be dissolved in water to be a dilution and then which releases the dilution quantitatively by the difference of liquid level. This lavatory cleanser dispensing device is composed of a fixing member 91 and a shell 93. The fixing member 91 includes a hanging portion 92 at a top end thereof for hooking a top edge of a toilet water tank and faces a bottom side of the toilet water tank at a bottom end thereof. The shell 93 is mounted to a bottom section of the fixing member 91 and includes a chamber 94 inside for containing solid lavatory cleanser. The shell 93 is provided with three rectangular inlets 95 formed at a top side thereof and three circular outlets 96 formed at a front side thereof; all of the inlets 95 and outlets 96 run through the chamber 94 for communication between the chamber 94 and outside. When the lavatory cleanser dispensing device 90 is mounted inside the toilet water tank, the inlets 95 are positioned above the outlets 96. When the water tank is filled with water, the water flows into the chamber 94 via the inlets 95 and the outlets 96 to dissolve the lavatory cleanser as the dilution, and then the dilution is quantitatively released out of the shell 93 via the outlets 96 after the user flushes the toilet.

However, there are many commercially available toilet water tanks of different sizes. When the aforementioned lavatory cleanser dispensing device 90 is mounted on a small toilet water tank that is less high than the cleanser dispensing device 90, the shell 93 is positioned at a bottom side of the water tank to incur that the hanging portion 92 of the fixing member 91 fails to be securely located on the water tank.

SUMMARY OF THE INVENTION

The primary objective of the present invention is to provide an improved lavatory cleanser dispensing device which height is adjustable to accommodate toilet water tanks of different sizes and which can dispense the cleanser quantitatively.

The foregoing objective of the present invention is attained by the improved lavatory cleanser dispensing device that is composed of a fixing member and a shell. The fixing member includes a hanging portion at a top side thereof to be hung on a toilet water tank and a plurality of locating portions formed at a bottom section thereof and in top-down arrangement. The shell includes at least one chamber inside, a plurality of inlets and outlets running therethrough to enable the chamber to communicate with outside, and at lease one positioning portion detachably mounted on the locating portions of the fixing members for adjusting the height of the present invention to accommodate the toilet water tanks of different sizes.

DETAILED DESCRIPTION OF THE INVENTION

Figure 1:
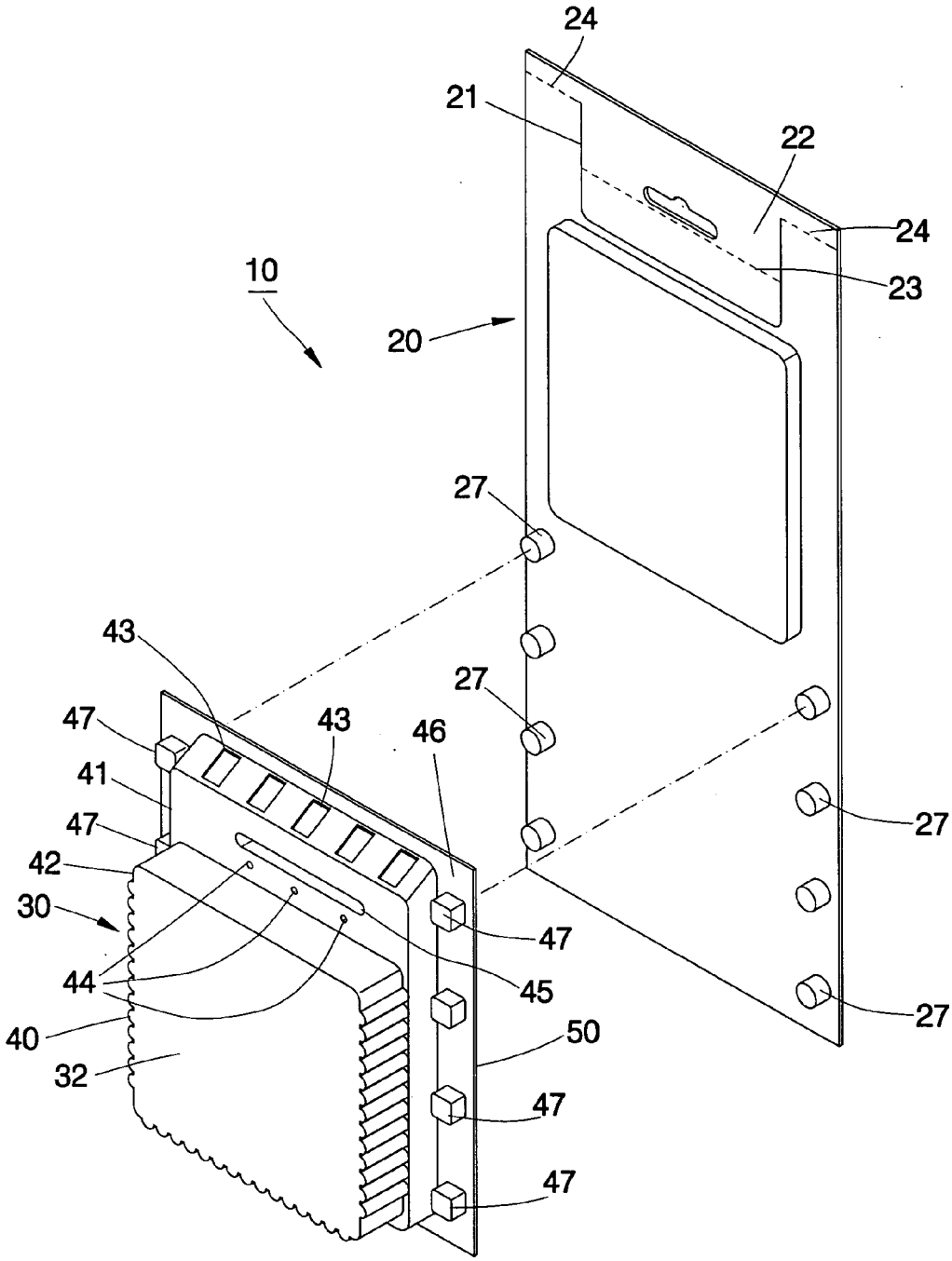
FIG. 1 is an exploded view of a first preferred embodiment of the present invention.
Figure 2:
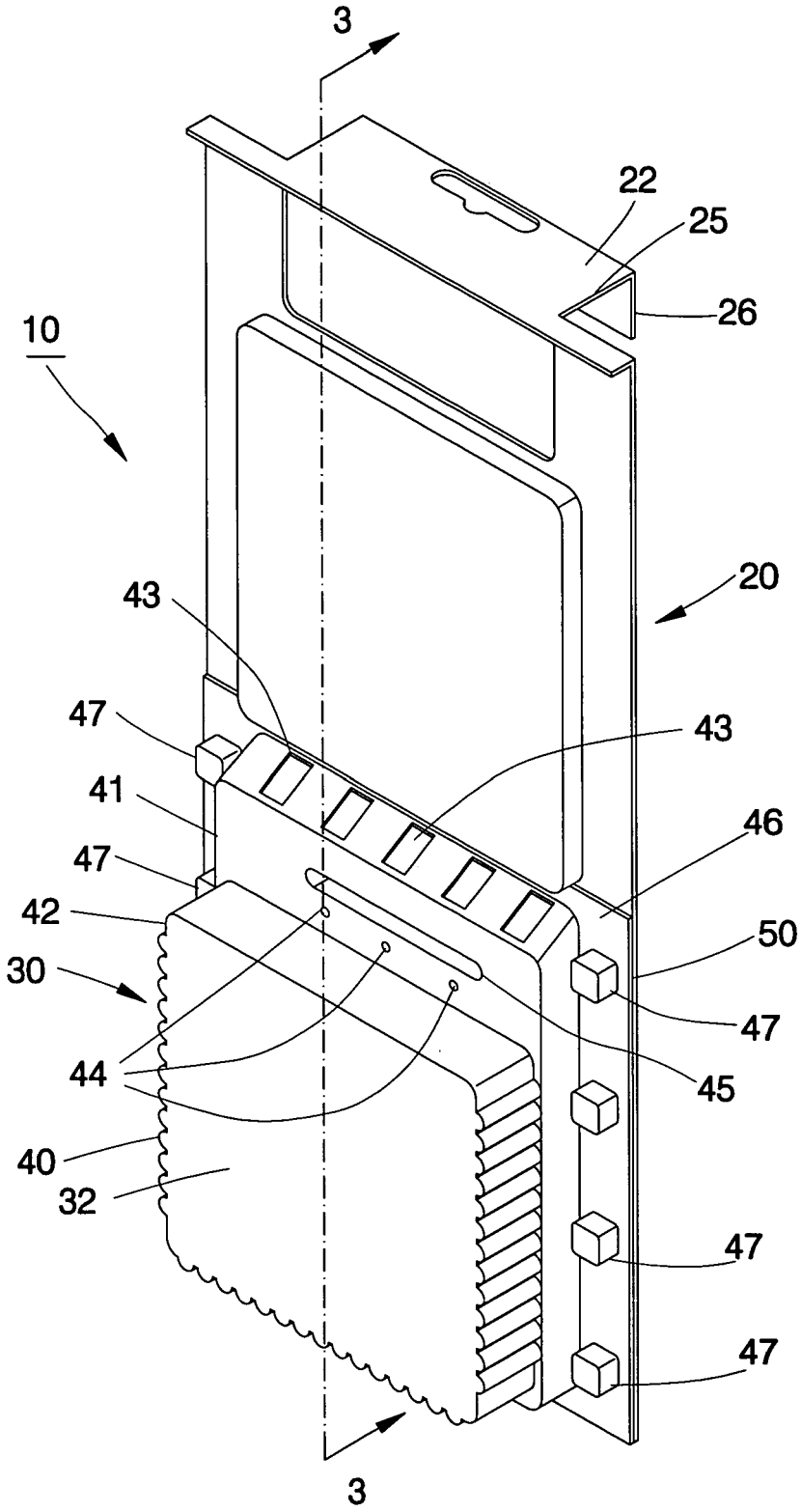
FIG. 2 is a perspective view of the first preferred embodiment of the present invention.
Figure 3:
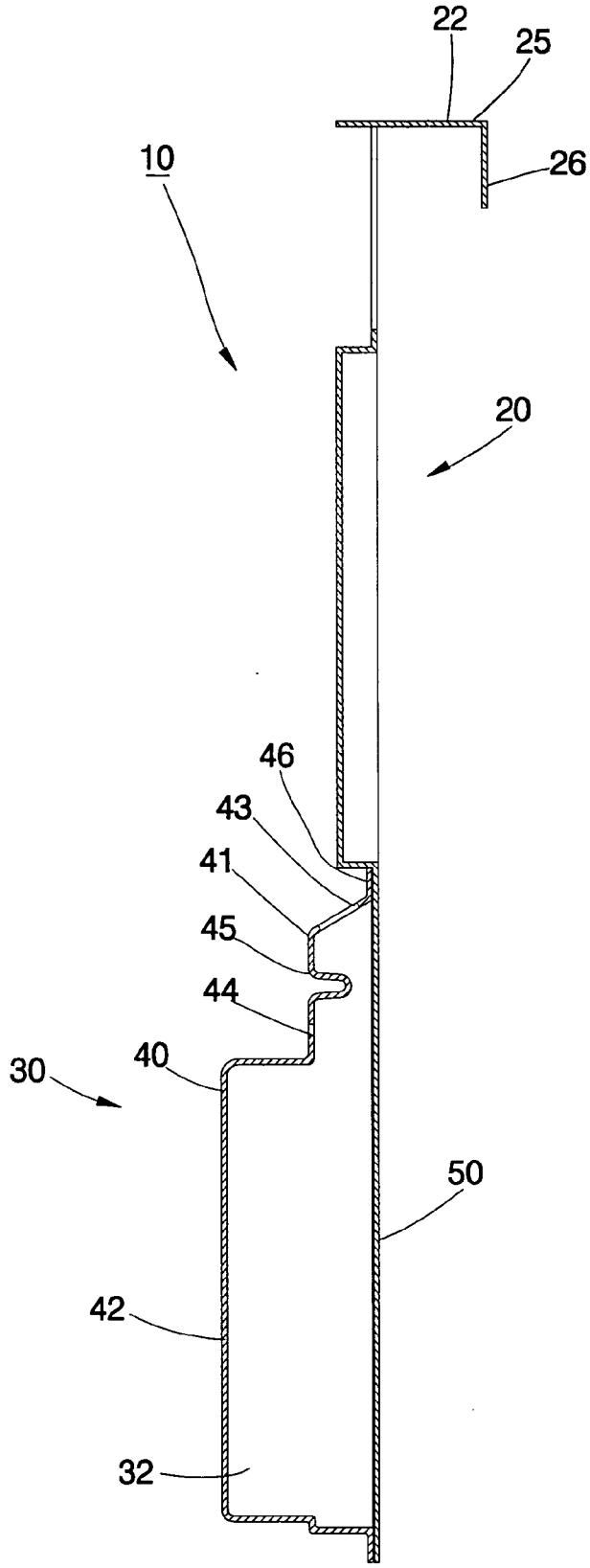
FIG. 3 is a sectional view indicated by a line 3—3 taken in FIG. 2.

Referring to FIGS. 1–3, a lavatory cleanser dispensing device 10 constructed according to a first preferred embodiment of the present invention is composed of a fixing member 20 and a shell 30.

The fixing member 20 is made of a rectangular plastic plate vacuum formed and processed and includes a fracture 21, a hanging portion 22, a first bendable potion 23, two second bendable portions 24, and eight locating portions 27. The fracture 21 is U-shaped and has an opening facing a short side of the fixing member 20, such that the hanging portion 22 is integrally formed at the fracture 21. The first bendable portion 23 is formed between two sides of the fracture 21 and the two second bendable potions 24 are formed respectively at the two sides of the fracture 21. When the fixing member 20 is not in use, the hanging portion 22 is smooth at a surface thereof and parallel to the fixing member 20. When the fixing member 20 is in use, the hanging portion 22 has a shoulder 25 bended along the first and second bendable portions 23 and 24 and extending towards a rear side of the fixing member 20, and an arm 26 extending vertically downwards from a distal end of the shoulder 25, adapting to hook a top edge of a toilet water tank. The eight locating portions 27, each of which is a column and each four of which are formed at one of two long sides of a bottom section of the fixing member 20 and in top-down arrangement.

The shell 30 is formed of a box-like member 40 and a sealing member 50.

The box-like member 40 is made of a plastic plate vacuum formed and processed and includes a chamber 32 protruding forwards therefrom. The chamber 32 has a rectangular first compartment 41 and a second compartment 42 protruding further forwards from a bottom section of the first compartment 41. The second compartment 42 is adapted for containing solid lavatory cleanser. The box-like member 40 includes five rectangular inlets 43 formed at a top side thereof and running therethrough to enable the chamber 32 to communicate with outside, three circular outlets 44 formed at a front side thereof and running therethrough to also enable the chamber 32 to communicate with outside, a baffle 45 recessed inwards towards the chamber 32 therefrom and positioned over the outlets 44, a circumventive frame 46 extending outwards from a periphery of a first compartment 41, and eight rectangular hollow positioning portions 47, each four of which are positioned at one of two long sides of the circumventive frame 46 and spaced apart from each other at a predetermined distance to be detachably fitted with the locating portions 27. The outlets 44 are tiny to refrain the fluid inside the chamber 32 from flowing too fast. When the box-like member 40 is fitted with the fixing member 20, the inlets 43 are positioned above the outlets 44.

The sealing member 50 is made of a flexible film sealing a rear side of the circumventive frame 46 of the box-like member 40 and includes eight cross incisions (not shown) corresponding respectively to the positioning portions 47.

Figure 4:
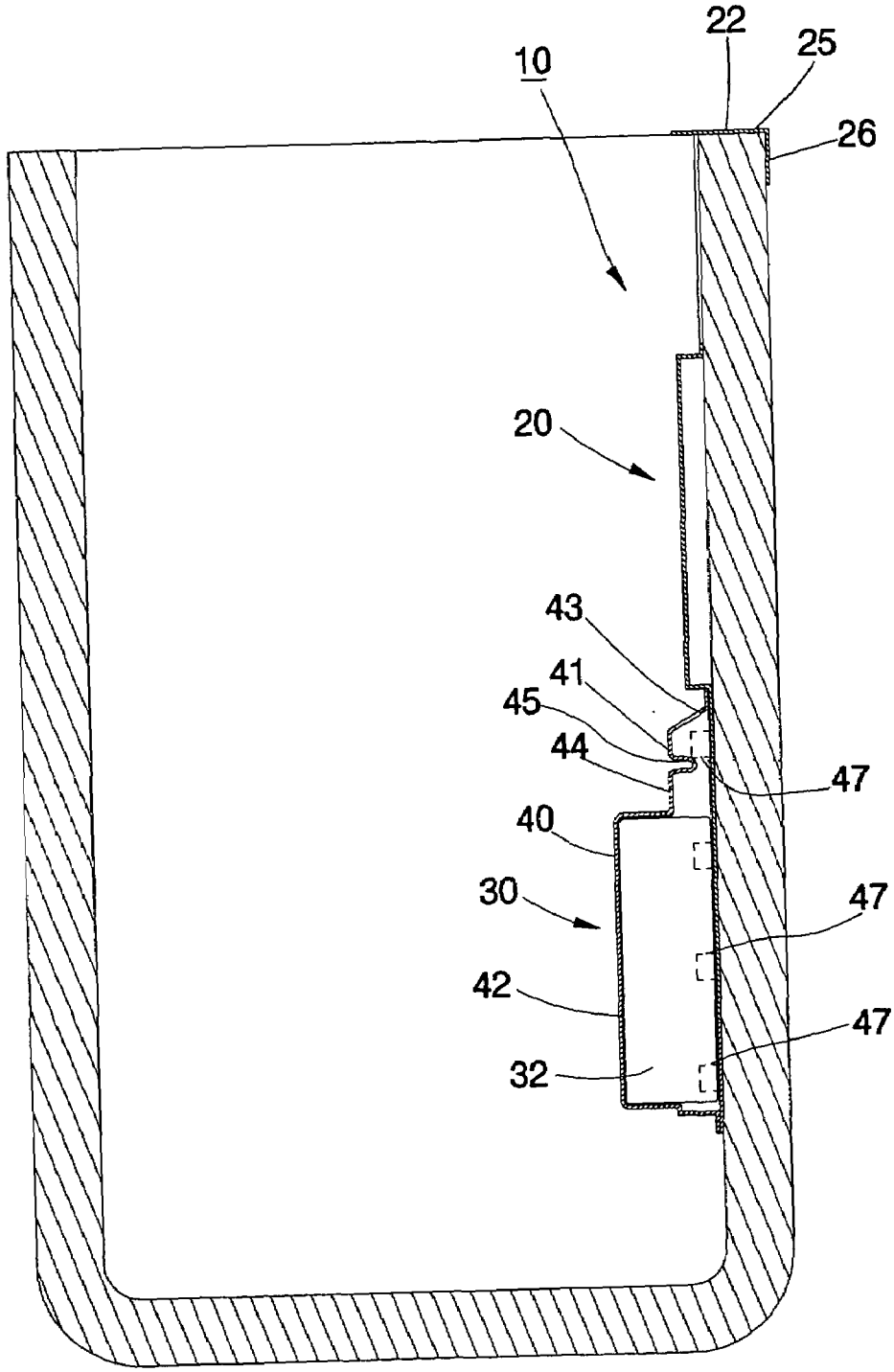
FIG. 4 is a sectional view of the first preferred embodiment of the present invention mounted on a small toilet water tank.

Referring to FIG. 4, when the present invention is mounted inside a small toilet water tank, the hanging portion 22 of the fixing member 20 can hook a top edge of the toilet water tank to enable the shell 30 to approach a bottom side of the water tank. When the water tank is filled with water, the water can flow into the chamber 32 via the inlets 43 and the outlets 44, and then some percents of the water contacts the baffle 45 and flows along a surface of the baffle 45 to stir up the water inside the first compartment 41, such that the solid lavatory cleanser inside the second compartment 42 can be averagely blended into the water to enable the chamber 32 filled with the blended fluid. When the user flushes the toilet to enable the water to flow out of the water tank until it's empty, according to the difference of fluid level, the fluid level of the blended fluid is higher than the position of the inlets 43 to enable the blended fluid to flow out of the outlets 44.

Figure 5:
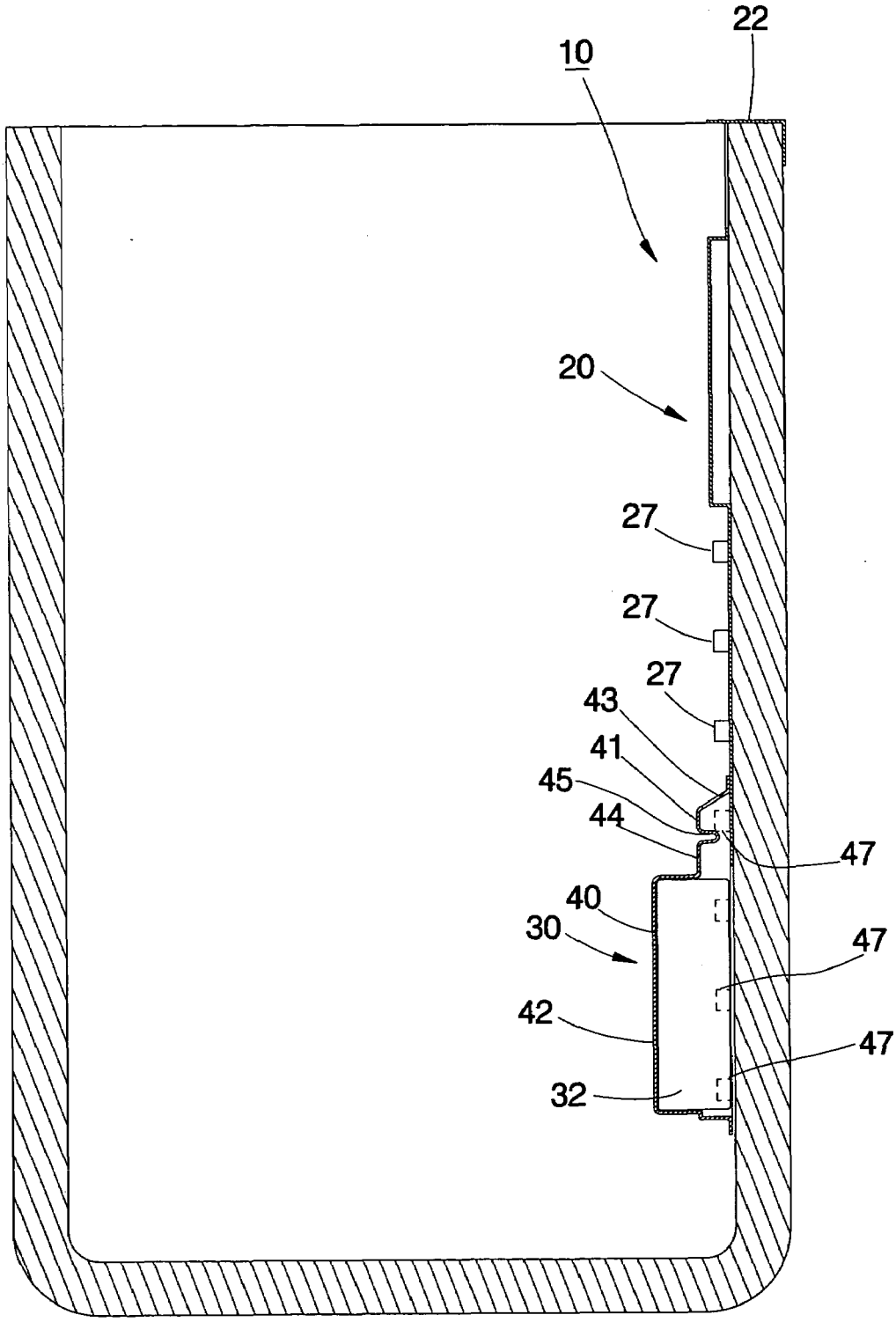
FIG. 5 similar to FIG. 4 shows that the present invention is mounted on a large toilet water tank.

Referring to FIG. 5, when the present invention is mounted on a large toilet water tank, the user can separate each of the positioning portions 47 from the locating portions 27 and then put the two positioning portions 47 positioned adjacent to a top side of the shell 30 to be fitted with the two corresponding locating portions 27 positioned adjacent to a bottom side of the fixing member 20 to increase the distance between the shell 30 and the hanging portion 22, thereby keeping the shell 30 positioned adjacent to the bottom side of the water tank. Accordingly, the user can adjust the height of the present invention to enable the present invention to accommodate the size of the toilet water tank.

Figure 6:
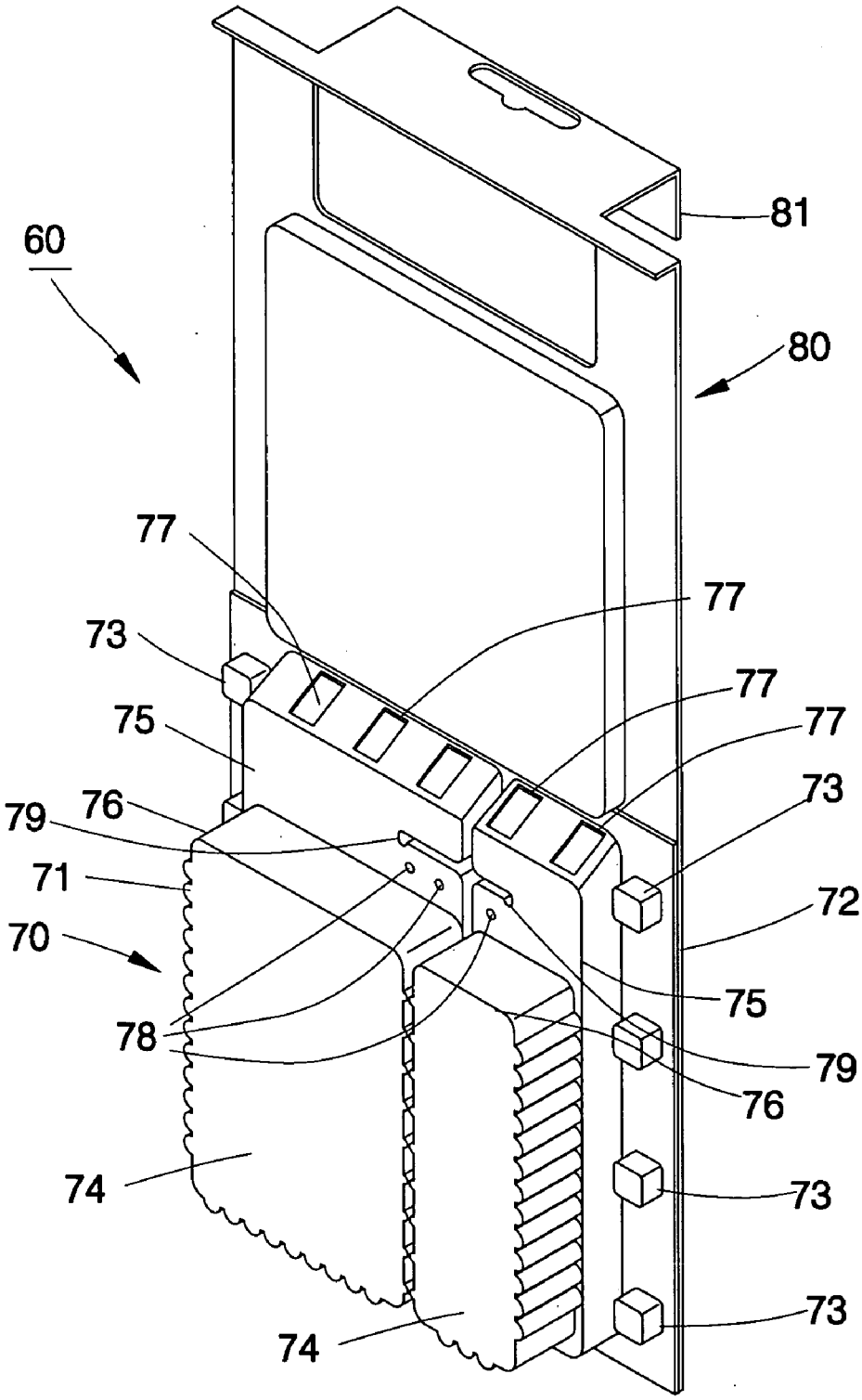
FIG. 6 is a perspective view of a second preferred embodiment of the present invention.
Figure 7:
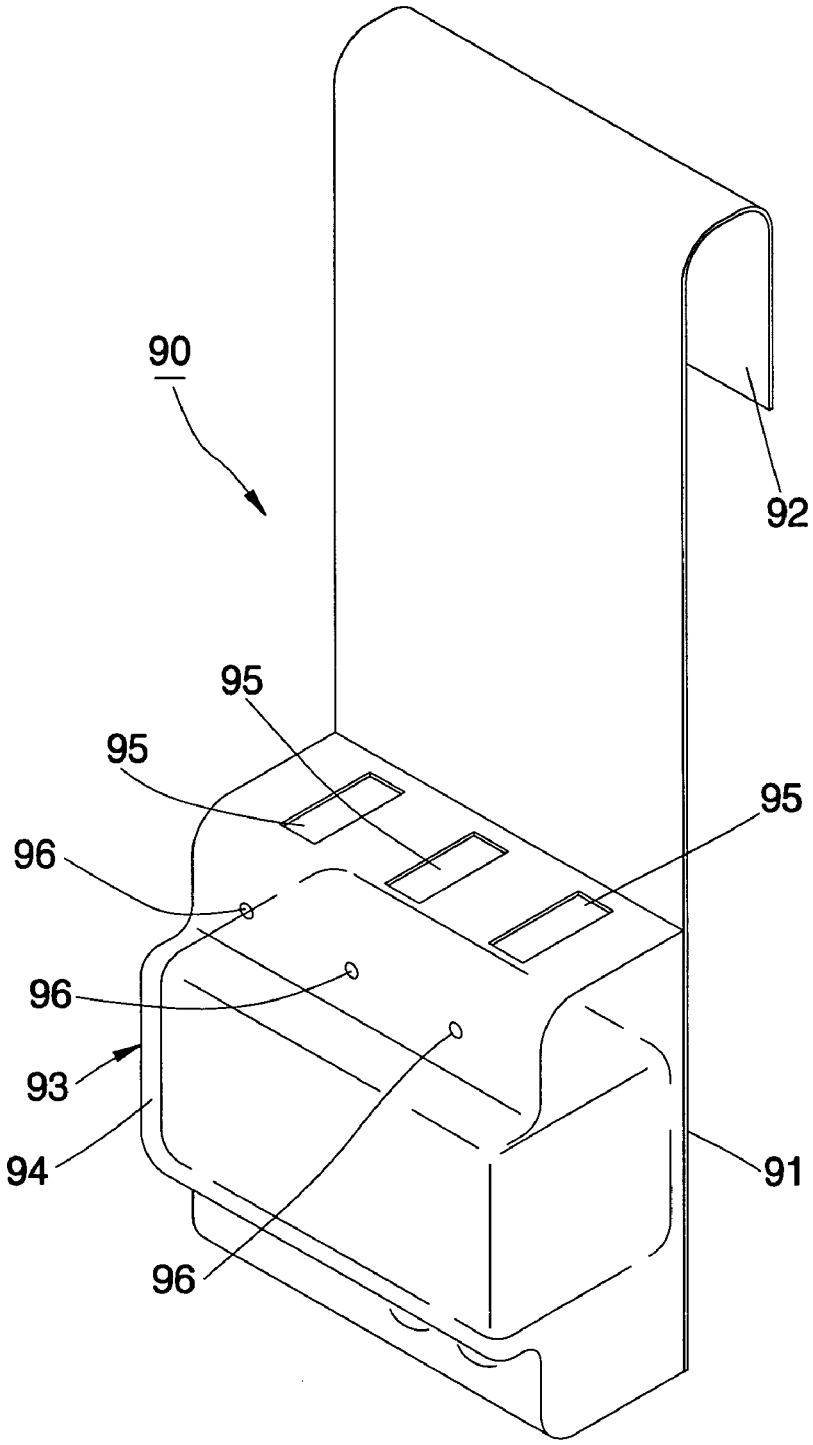
FIG. 7 PRIOR ART
FIG. 7 is a perspective view of the prior art.

Referring to FIG. 6, the lavatory cleanser dispensing device 60 constructed according to a second preferred embodiment of the present invention is different from the first preferred embodiment only by that the box-like member 71 of the shell 70 includes two chambers 74, each of which has a first compartment 75 and a second compartment 76, a plurality of inlets 77 and outlets 78 formed at the two first compartments 75, and two baffles 79 formed above the outlets 78. One of the second compartments 76 contains solid lavatory cleanser and the other contains solid lavatory aroma. Accordingly, the present invention of the second preferred embodiment can also release the lavatory cleanser and aroma quantitatively.

What is claimed is:

1. A lavatory cleanser dispensing device that is height-adjustable and releases lavatory cleanser quantitatively, said lavatory cleanser dispensing device comprising:

a fixing member having a hanging portion at a top side thereof and a plurality of locating portions positioned at a bottom section thereof and in top-down arrangement, said hanging portion hanging on a toilet water tank;

a shell having at least one chamber inside, a plurality of inlets and outlets for communication between said chamber and outside, and at least one positioning portion detachably mounted on said locating portions;

wherein said shell further comprises a circumventive frame extending outwards from a periphery of said chamber; said positioning portions are positioned on said circumventive frame and on opposite sides of said chamber and spaced apart from each other at a predetermined distance; and wherein said fixing member is rectangular; said hanging portion is positioned at a short side of said fixing member; said locating portions are positioned respectively at two long sides of a bottom section of said fixing member and spaced apart from each other at a predetermined distance.

2. The lavatory cleanser dispensing device as defined in claim 1, wherein said fixing member comprises a fracture; said hanging portion is integrally formed at said fracture, said hanging portion having a first bendable portion and a second bendable portion, said hanging portion being smooth while not in use, said hanging portion having a shoulder extending towards a rear side of said fixing member along said first and second bendable portions and an arm extending vertically downwards from a distal end of said shoulder.

3. The lavatory cleanser dispensing device as defined in claim 1, wherein each of said positioning portions is a hollow rectangular pillar having an opening.

4. The lavatory cleanser dispensing device as defined in claim 1, wherein each of said locating portions is a column.

* * * * *